US005899613A

United States Patent [19]

Koike et al.

[11] Patent Number: 5,899,613

[45] Date of Patent: May 4, 1999

[54] IMAGE RECORDING APPARATUS HAVING CONVEYING MEANS FOR BOTH CONTINUOUS SHEET AND SINGLE SHEET

[75] Inventors: Yasushi Koike, Kawasaki; Yoji Ara, Yokohama; Jun Katayanagi, Musashino; Masaaki Kakizaki, Kawasaki; Nozomu Nishiberi; Seiji Ogasawara, both of Yokohama, all of Japan

[73] Assignee: Canon Kabushiki Kaisha, Tokyo, Japan

[21] Appl. No.: 08/825,131

[22] Filed: Mar. 27, 1997

[30] Foreign Application Priority Data

Mar. 29, 1996 [JP] Japan ..... 8-103480

[51] Int. Cl.[6] ..... B65H 5/06; G03G 15/00

[52] U.S. Cl. ..... 399/384; 271/9.1; 399/391; 400/605

[58] Field of Search ..... 399/384, 388, 399/389, 391, 361; 347/56, 153; 271/4.01, 9.01, 9.1; 400/605, 616.1, 617, 618, 616, 636, 637.1, 639.1, 639.2

[56] References Cited

U.S. PATENT DOCUMENTS

| | | | |
|---|---|---|---|
| 4,789,259 | 12/1988 | Katayanagi | 400/624 |
| 5,308,175 | 5/1994 | Ito | 400/605 |
| 5,478,162 | 12/1995 | Nakayama et al. | 400/605 |

FOREIGN PATENT DOCUMENTS

| | | |
|---|---|---|
| 0 297 486 | 1/1989 | European Pat. Off. . |
| 0 661 165 | 7/1995 | European Pat. Off. . |
| 80 06 136 | 6/1980 | Germany . |
| 32 09 085 | 10/1982 | Germany . |
| 215 976 | 11/1984 | Germany . |
| 41 04 970 | 8/1992 | Germany . |
| 02-55169 | 2/1990 | Japan . |
| 04-41264 | 2/1992 | Japan . |

OTHER PUBLICATIONS

C.D. Bleau, et al., *Document Entry Mechanism for Typewriter Paper Handler, IBM Technical Disclosure Bulletin*, vol. 21, No. 2, pp. 709–710, Jul. 1978, New York, U.S.A.

Patent Abstracts of Japan, vol. 011, No. 302 (M–629), Oct. 2, 1987 & JP 62–094365 (Tokyo Electric Co. Ltd.), Apr. 30, 1987.

*Primary Examiner*—Fred L. Braun
*Assistant Examiner*—Sophia S. Chen
*Attorney, Agent, or Firm*—Fitzpatrick, Cella, Harper & Scinto

[57] ABSTRACT

The present invention provides an image recording apparatus with an image recording unit for recording an image on a recording medium, a first conveyor for conveying the recording medium to an image recording portion of the image recording unit while bending the recording medium along a drive convey roller by means of the drive convey roller, and a second conveyor for conveying an elongated recording medium having a plurality of pin holes to the first conveyor. A guide capable of changing a contact area between the recording medium and the drive convey roller at a curved portion of the recording medium along the drive convey roller is also provided.

14 Claims, 9 Drawing Sheets

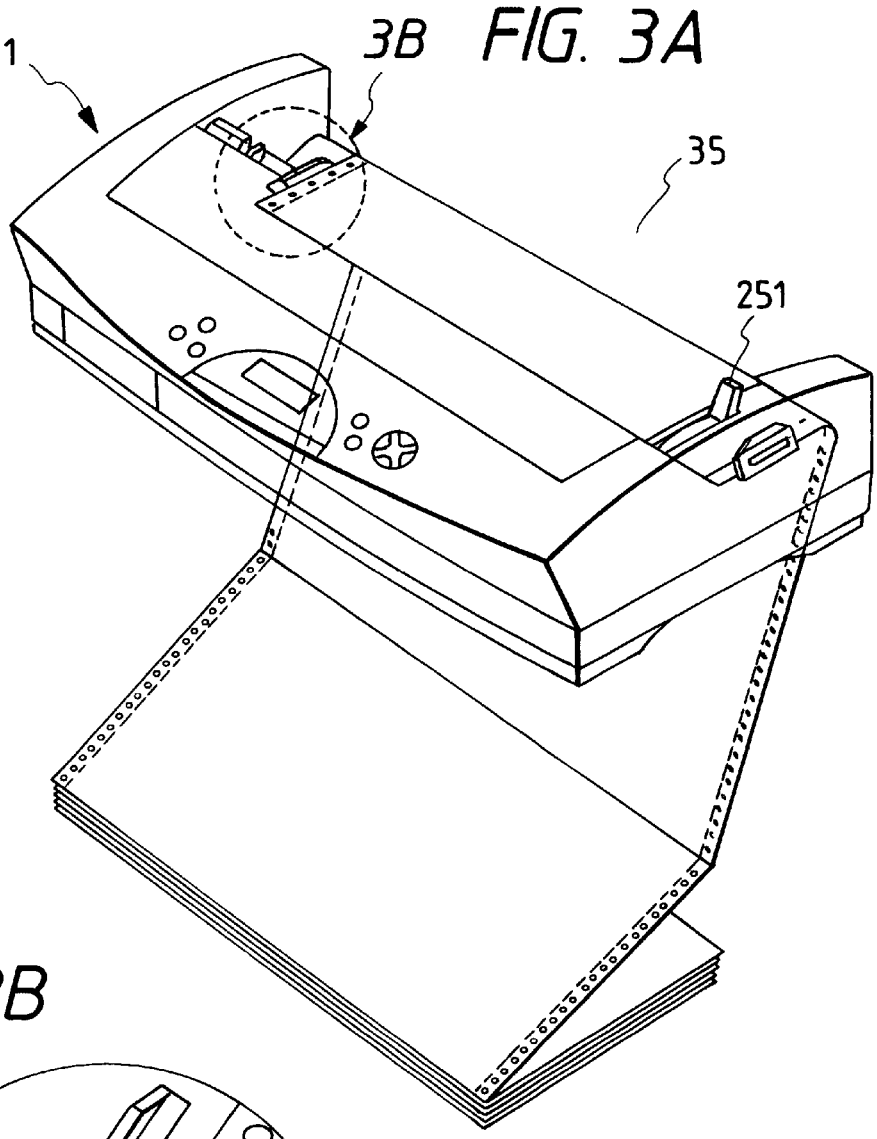
FIG. 3A
FIG. 3B
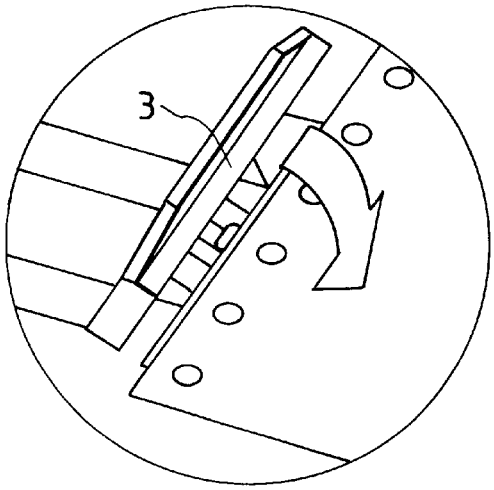

IMAGE RECORDING APPARATUS HAVING CONVEYING MEANS FOR BOTH CONTINUOUS SHEET AND SINGLE SHEET

BACKGROUND OF THE INVENTION

1. Field of the Invention

The present invention relates to an image recording apparatus in which a single sheet (for example, a cut sheet) and an elongated sheet (for example, a fan-fold sheet) can selectively be used. More particularly, it relates to an image recording apparatus including a convey means having a specific feature.

2. Related Background Art

In the past, as an output apparatus for a personal computer or a facsimile, image recording apparatuses having a pin feed tractor have been used.

An example of such conventional image recording apparatuses will now be explained with reference to FIG. 9 showing a construction of the conventional image recording apparatus as a sectional view. As a convey means for a recording medium, there are provided a convey roller 450 and pinch rollers 451*a,* 451*b* urged against the convey roller to be followingly driven therewith, and a so-called U-turn path is formed so that the recording medium is conveyed around the convey roller 450. For example, when a cut sheet is used as the recording medium, the cut sheet is pinched between the convey roller 450 and the pinch rollers 451*a,* 451*b* to be conveyed by a friction generated between the sheet and the rollers.

On the other hand, a continuous sheet (referred to as "fan-fold sheet" hereinafter) is used as the recording medium, pin holes of the fan-fold sheet are engaged by pins 452*a* of a pin feed tractor (referred to merely as "tractor" hereinafter) 452, and the fan-fold sheet is pinched between the convey roller 450 and the pinch rollers 451*a,* 451*b* to be conveyed to a recording portion by a friction generated between the sheet and the rollers. In this case, there is no problem so long as a conveying amount of the sheet given by the tractor 452 is always the same as a conveying amount of the sheet given by the convey roller 450. However, in fact, since there is a difference in speed between the tractor and the convey roller due to the dimensional tolerance and environmental condition, the pinch rollers 451*a,* 451*b* are disengaged from the convey roller 450 so that a conveying force of the convey roller 450 is not transmitted to the fan-fold sheet.

After an image is recorded on the recording medium by a recording head 453 in response to image information, the recording medium is discharged by a sheet discharge roller 454 and a pinch roller 455 urged against the sheet discharge roller.

However, in the above-mentioned conventional technique, since the fan-fold sheet is also conveyed around the convey roller 450, even when the pinch rollers 451*a,* 451*b* are disengaged from the convey roller, the conveying force of the convey roller is transmitted to the fan-fold sheet, with the result that sheet jam sometimes occur due to the difference in speed between the tractor 452 and the convey roller 450.

For example, when relation St<Sf is established assumed that a conveying speed of the tractor 452 is St and a conveying speed of the convey roller 450 is Sf, excessive tension acts on the fan-fold sheet between the tractor 452 and the convey roller 450, so that the sheet may be torn to cause the sheet jam. Further, even when a surface of the convey roller 450 is smooth-finished to decrease transmission of the conveying force from the convey roller to the fan-fold sheet, a conveying force between the convey roller 450 and the pinch rollers 451*a,* 451*b* required for conveying the cut sheet is decreased, thereby causing poor sheet conveyance (slip). Further, since the convey roller 450 is made of material such as rubber having relatively high frictional coefficient, a slipping condition of the surface of the roller is changed in accordance with the environmental condition. In particular, under a high temperature/high humidity condition, the coefficient of friction of the surface of the convey roller is greatly increased, so that, when the fan-fold sheet is conveyed around the convey roller, the conveying force acting on the fan-fold sheet cannot stably be reduced.

On the other hand, when relation St>Sf is established, the fan-fold sheet is loosed between the tractor 452 and the convey roller 450, so that the pin holes of the fan-fold sheet are disengaged from the pins 452*a* of the tractor 452 to thereby cause the sheet jam.

SUMMARY OF THE INVENTION

The present invention intends to eliminate the above-mentioned conventional drawbacks, and has an object to provide an image recording apparatus having a convey means capable of properly conveying both a single sheet (for example, a cut sheet) and an elongated sheet (for example, a fan-fold sheet).

To achieve the above object, in the present invention, an image recording apparatus comprises an image recording means for recording an image on a recording medium, a first convey means for conveying the recording medium to an image recording portion of the image recording means while bending the recording medium along a drive convey roller by means of the drive convey roller, and a second convey means for conveying an elongated recording medium having a plurality of pin holes to the first convey means, and further comprising a guide means capable of changing a contact area between the recording medium and the drive convey roller at a bent portion of the recording medium along the drive convey roller.

In the present invention, by changing the contact area between the recording medium and the drive convey roller in accordance with the kind of the recording medium by using the guide means, a conveying force transmitted from the drive convey roller to the recording medium can be changed. When the elongated recording medium is conveyed, the contact area may be decreased by the guide means, so that the conveying force transmitted from the first drive means may be decreased.

In the case where there is provided a driven roller supported for movement to be engaged with or disengaged from the drive convey roller and having a switching means for selecting such engagement or disengagement, when conveying the single recording medium, it may be conveyed while being pinched between the drive convey roller and the driven roller; when conveying the elongated recording medium, it may be conveyed in a condition that the driven roller is disengaged from the drive convey roller. With this arrangement, by switching the engagement (nipping) and disengagement (separation) of the driven roller, the conveying force transmitted from the drive convey roller to the recording medium can be changed.

The guide means may be fixedly supported independently from the drive convey roller, and a guide member having a projection protruding toward the recording medium may be provided at a non-contact position between the driven roller and the drive convey roller. With this arrangement, in the condition that the driven roller is disengaged from the drive convey roller, the recording medium can be spaced apart from the drive convey roller not to transmit the conveying force from the drive convey roller to the recording medium.

The guide member may be disposed coaxial with the drive convey roller. With this arrangement, the guide member can accurately be positioned with respect to the surface of the drive convey roller.

Further, the guide means may include a guide member shiftable, independently from the drive convey roller, between a first position to be protruded toward the recording medium and a second position not to be protruded toward the recording medium with respect to the drive convey roller, and a shift means for shifting the guide member. With this arrangement, when the guide member is in the first position, the recording medium can be spaced apart from the drive convey roller.

When the single recording medium is conveyed the guide member may be shifted to the first position, and when the elongated recording medium is conveyed it may be shifted to the second position.

The guide member may be partially provided in a direction perpendicular to a recording medium conveying direction. With this arrangement, when the conveying force from the drive convey roller is required, it can be transmitted to the recording medium sufficiently.

The guide member may include a guide for directing the recording medium conveyed by the second convey means to a correct position of the first convey means. Further, the guide member may also include a guide for direction the recording medium from the first convey means to a correct position of the image recording portion. The guide member may be formed from conductive material and may be earthed.

With this arrangement, a bad influence due to static electricity generated by the friction between the recording medium and the guide member can be prevented. When the elongated recording medium is conveyed, the second convey means may include a pin feed tractor so that the recording medium is conveyed while engaging pin holes of the recording medium by pins of the tractor.

Further, in an image recording apparatus comprising an image recording means for recording an image on a recording medium, a drive convey roller for conveying the recording medium to an image recording portion of the image recording means while bending the recording medium along the drive convey roller, a driven (following rotating) roller capable of being engaged by and disengaged from the drive convey roller and capable of conveying the recording medium while pinching the recording medium between the drive convey roller and the driven roller, and a second convey means for conveying a recording medium having a plurality of pin holes to a nip between the drive convey roller and the driven roller, a guide member is provided at a bent portion and at position other than a nip between the drive convey roller and the driven roller. It has a protruded portion for conveying the recording medium while spacing the recording medium apart from the drive convey roller.

With this arrangement, when the driven roller is disengaged from the drive convey roller, the recording medium is conveyed while being spaced apart from the drive convey roller.

BRIEF DESCRIPTION OF THE DRAWING

FIG. 3A is a perspective view showing a condition that a continuous sheet is set to the image recording apparatus according to the first embodiment, and FIG. 3B is an enlarged view of a main portion of FIG. 3A;

FIG. 5A shows a condition that a cut sheet is conveyed, and FIG. 5B shows a condition that a continuous sheet is conveyed;

FIG. 7A shows a condition that a cut sheet is conveyed, and FIG. 7B shows a condition that a continuous sheet is conveyed;

DETAILED DESCRIPTION OF THE PREFERRED EMBODIMENTS

The present invention will now be explained in connection with embodiments thereof with reference to the accompanying drawings. However, the present invention is not limited to dimensions, materials, configurations and relative positions of elements described in these embodiments, except for limitative description.

First Embodiment

FIGS. 1, 2, 3A, 3B, 4, 5A, 5B and 6 show a first embodiment of the present invention. Now, a convey means which is a main characteristic of an image recording apparatus according to the first embodiment will be fully described.

Figure 1:
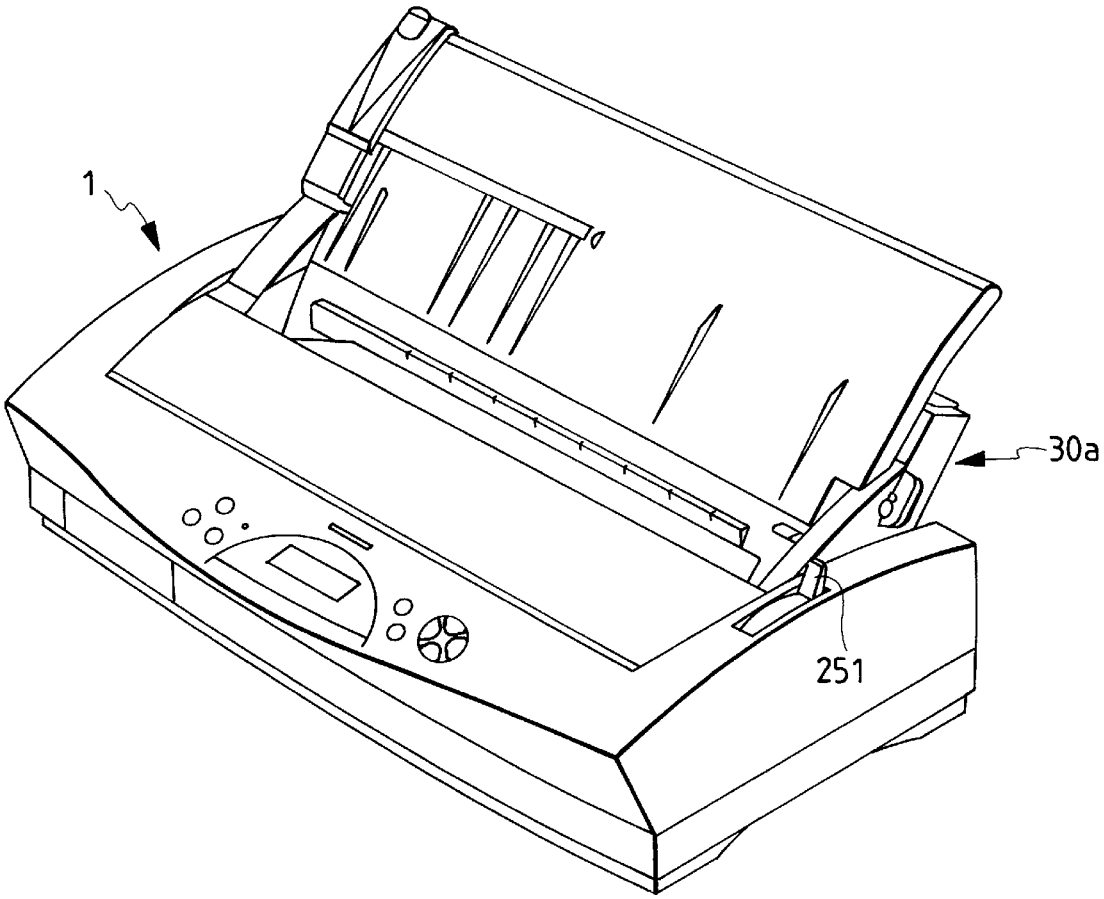
FIG. 1 is a perspective view showing a condition that an automatic sheet supplying apparatus is mounted on an image recording apparatus according to a first embodiment of the present invention.
Figure 2:
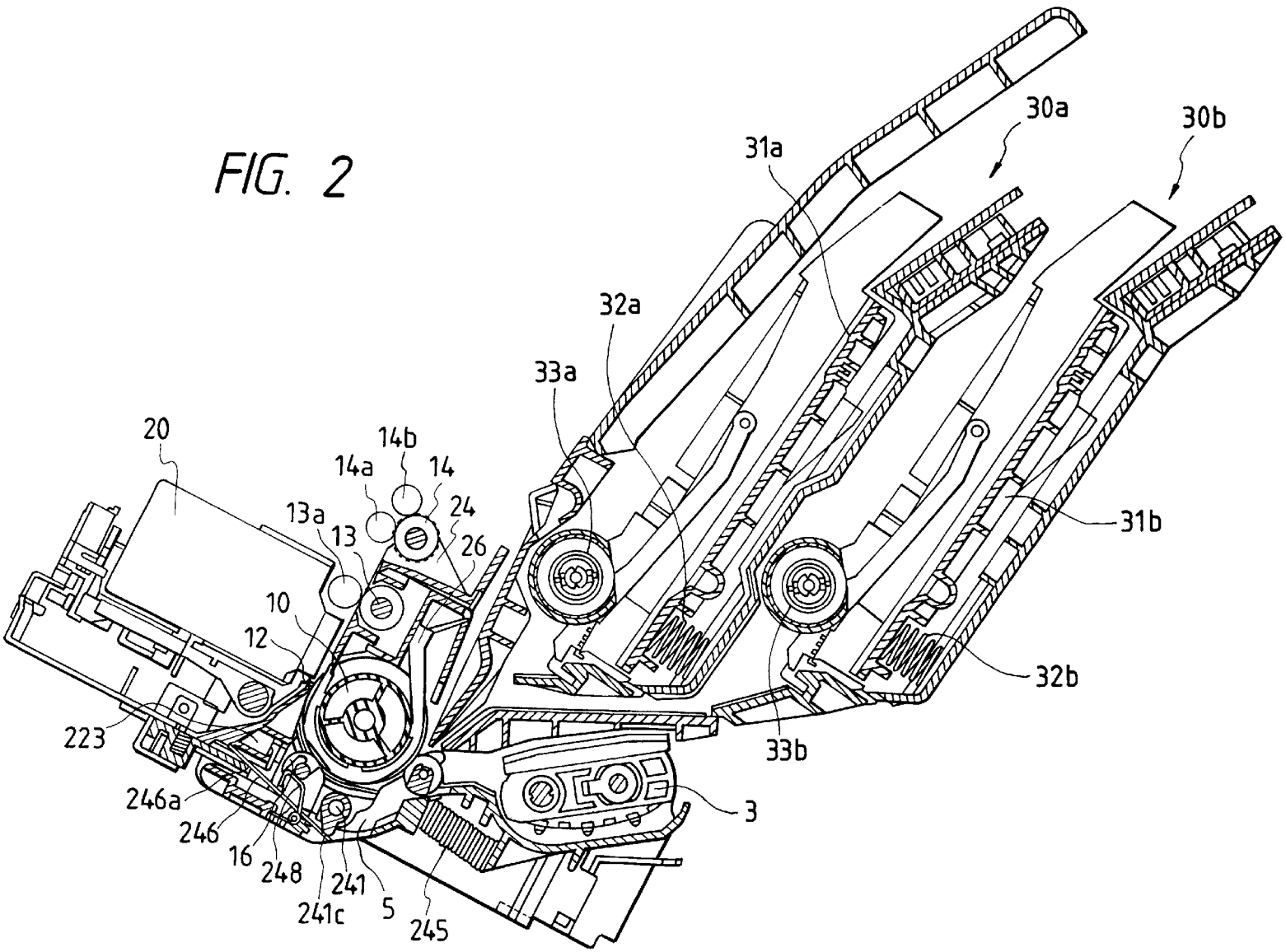
FIG. 2 is a sectional view showing a condition that an automatic sheet supplying apparatus is mounted by two pins on the image recording apparatus according to the first embodiment.
Figure 4:
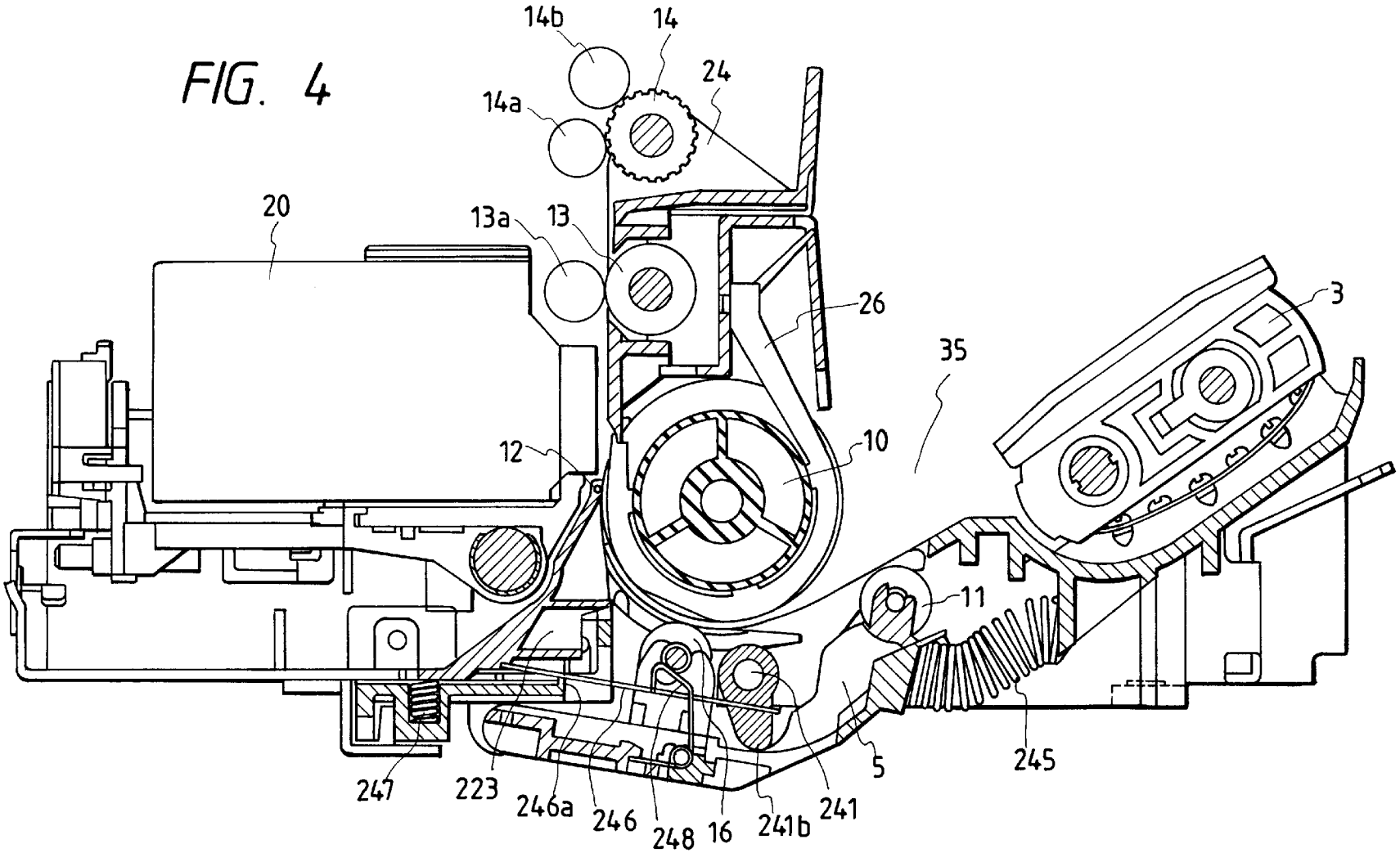
FIG. 4 is a sectional view of a main portion of the image recording apparatus according to the first embodiment, showing a condition that the continuous sheet is supplied.

FIG. 1 is a perspective view showing a condition that an automatic sheet supply unit (also referred to as "ASF" (automatic sheet feeder) hereinafter, and FIG. 2 is a sectional view showing a condition that the ASF of FIG. 1 is mounted on the image forming apparatus by two pins. FIG. 3A is a perspective view showing a condition that a continuous sheet is set, and FIG. 4 is a sectional view showing a condition that the continuous sheet is supplied.

In the image recording apparatus 1, as a recording medium, a single sheet (referred to as "cut sheet" hereinafter) such as a normal recording sheet, a post card and the like, and a continuous sheet such as a fan-fold sheet can be used. For example, when the cut sheet as the single recording medium is used, the sheet can be supplied by using the ASF or can be supplied by manual insertion.

As shown in FIG. 2, the ASF has two pins 30*a*, 30*b*. With this arrangement, two kinds of cut sheets having different sizes can be set simultaneously and either of the cut sheets can be used by operator's selection. Sheet supply mechanisms of the pins 30*a,* 30*b* have the same construction, in which a plurality of cut sheets (not shown in FIG. 2) stacked on urging plates 31*a,* 31*b* are biased against pick-up rollers 33*a,* 33*b* by springs 32*a,* 32*b,* and the cut sheets can be separated and supplied one by one by means of the pick-up rollers 33*a,* 33*b* rotated in response to sheet supply command.

Next, a first convey means when the cut sheet is used will be explained. When a release lever (switching means) 251 is set to a cut sheet supply mode, a pinch roller (driven roller) 11 held on a pinch roller holder 5 is urged against a convey roller (drive convey roller) 10 by a pinch roller spring 245. Similarly, an auxiliary roller (driven roller) 16 held by the pinch roller holder 5 for vertical movement is urged against the convey roller 10 by an auxiliary roller spring 248 provided on the pinch roller holder 5. As a result, the cut sheet supplied from the ASF can be conveyed to a recording area by a rotation of the convey roller 10 through a convey path formed around the convey roller.

In the recording area, a needle roller 12 is held on a needle roller holder 223 and is biased against the convey roller 10 by a needle roller spring 246. In this case, flexion is generated in the needle roller spring 246 by a projection 241*c* formed on a release shaft 241, thereby providing an urging force by a spring elastic force acting around a contact point 246*a* between the spring and the projection. The cut sheet is subjected to an additional conveying force at this point and is passed through an image recording portion between a recording head 20 and a platen 24.

The conveyance of the cut sheet is effected intermittently for each scan of the recording head 20, and a convey amount is determined in consideration of a length (in a cut sheet conveying direction) of an array of a plurality of image recording means provided in the recording head (ink discharge openings in case of an ink jet printer, and wires in case of a wire impact printer). After the recording is effected on the cut sheet by repeating the scan and conveyance alternately, the cut sheet is successively conveyed upwardly by a gap roller 13 and a sheet discharge roller 14 (and pinch rollers 13*a,* 14*a* urged against the gap roller and the sheet discharge roller, respectively) and then is discharged by a pinch roller 14*b*.

On the other hand, when a continuous sheet (fan-fold sheet) as an elongated recording medium is used, the ASF is not used, and as shown in FIGS. 3A and 3B, the continuous sheet supplied through a sheet supply opening 35 is conveyed by driving a pin feed tractor (referred to merely as "tractor" hereinafter) 3 as a second convey means.

Explaining the first convey means in the case where the continuous sheet is used, when the release lever 251 (FIG. 1) is set to a continuous sheet supply mode, the release shaft 241 is rotated. As a result, as shown in FIG. 4, the pinch roller holder 5 is urged by the projection 241*b,* thereby separating the pinch roller 11 from the convey roller 10 to retard the pinch roller from the convey path. Since a pivot point of the pinch roller holder 5 is positioned near the needle roller holder 223, the auxiliary roller 16 held by the pinch roller holder 5 for vertical movement similarly tries to separate from the convey roller 10, but due to the presence of the auxiliary roller spring 248 a conveying force from the auxiliary roller to the convey roller 10 is merely weakened. Further, the urging of the projection 241*c* against the needle roller spring 246 is released.

However, the biasing force of the needle auxiliary spring 247 is not released. Therefore, when the continuous sheet is conveyed, the urging force of the needle roller 12 against the convey roller 10 is always maintained to a proper condition, without depending upon biasing forces of any springs other than the needle auxiliary spring 247. The continuous sheet conveyed to the recording area is successively conveyed upwardly by the intermittent conveyance after each scan of the recording head 20, and the recording is effected on the sheet.

Next, a detailed mechanism of the convey roller portion in the conveyance of the cut sheet and the continuous sheet will be explained.

Figure 5B:
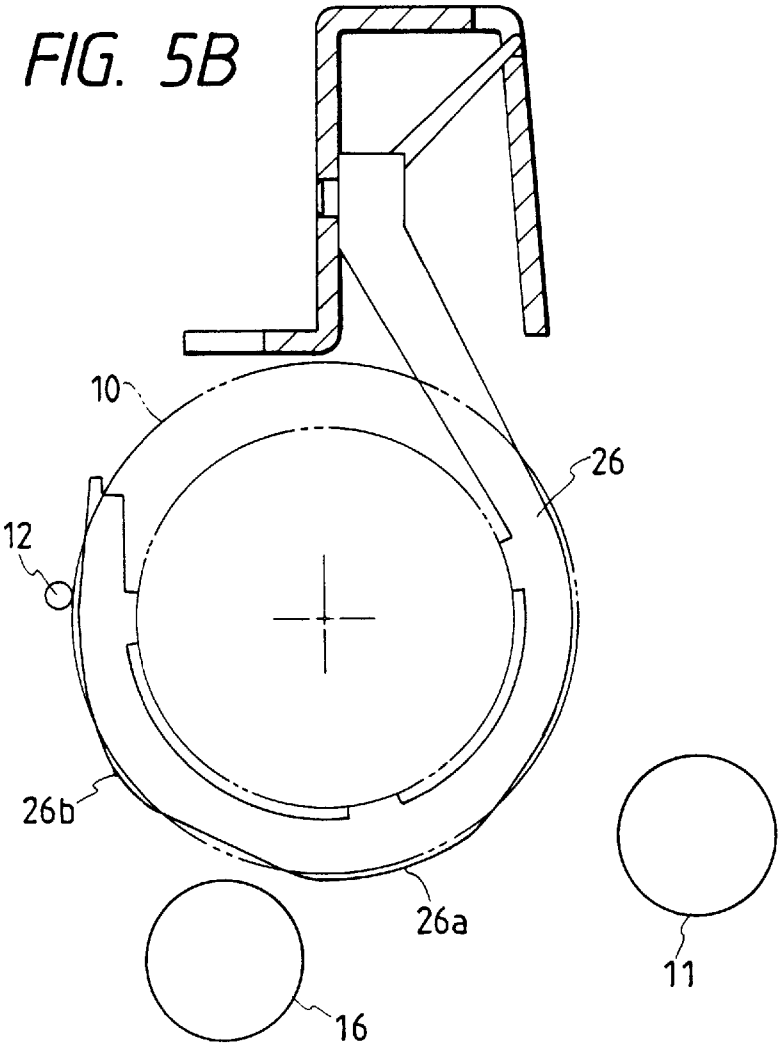
FIGS. 5A and 5B are schematic sectional views of a first convey means of the image recording apparatus according to the first embodiment, where
Figure 5A:
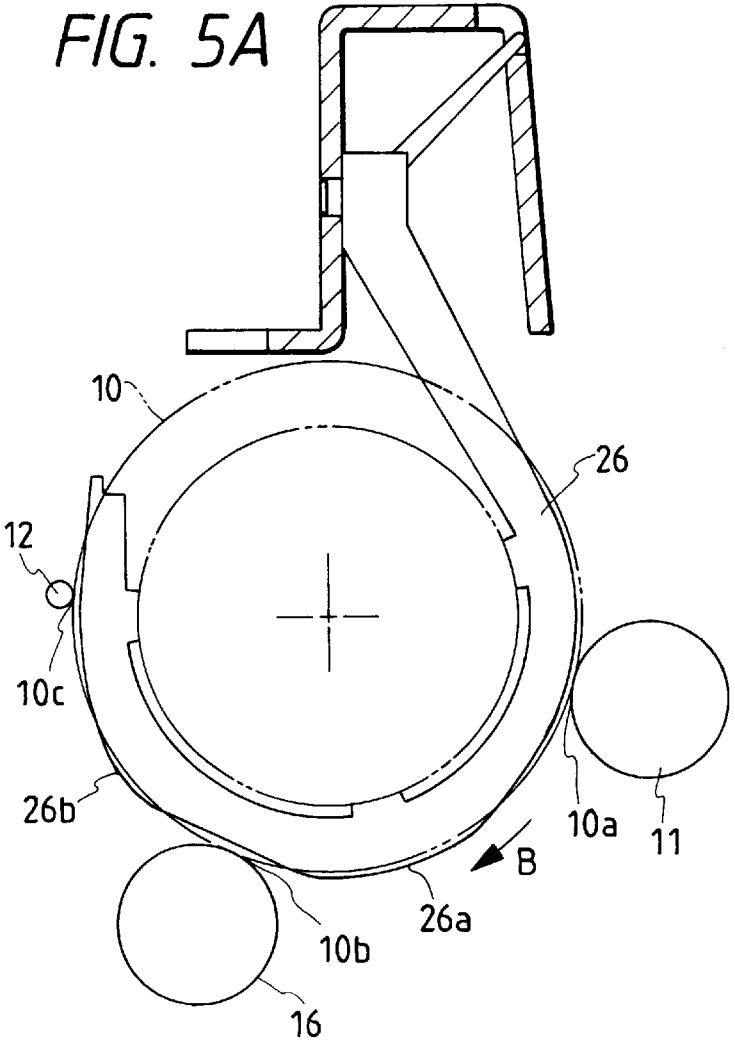
Figure 6:
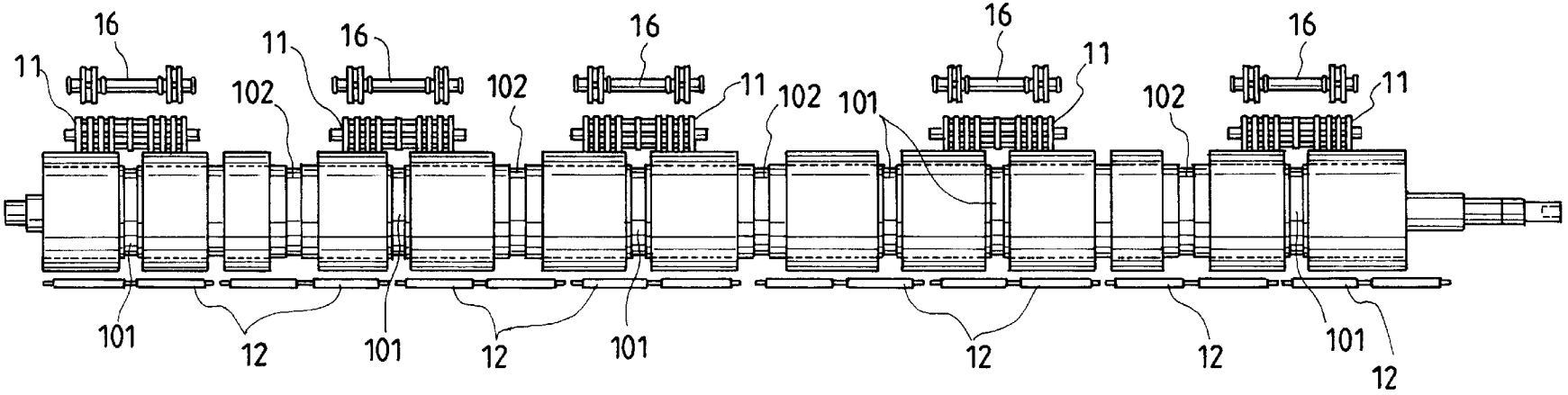
FIG. 6 is a view showing engagement positions of pinch rollers and auxiliary rollers with respect to a drive convey roller in the image recording apparatus according to the first embodiment.

FIGS. 5A and 5B are schematic sectional views of a convey portion of the sheet convey system, where FIG. 5A shows a condition that the cut sheet is conveyed and FIG. 5B shows a condition that the continuous sheet is conveyed. FIG. 6 shows engagement positions of the pinch roller 11, auxiliary roller 16 and needle roller 12 against the convey roller.

As shown in FIG. 5A, the pinch roller 11, auxiliary roller 16 and needle roller 12 are urged against the convey roller 10, respectively, as mentioned above. As shown in FIG. 6, a series of grooves are formed in the convey roller 10 to divide the convey roller into a plurality of roller portions in a direction transverse to the sheet conveying direction, and guide members 26 are disposed in the respective grooves so that a roller surface and a guide surface are alternately exposed to the recording medium. The guide members are arranged in coaxial with the convey roller 10. Further, in the sheet conveying direction B, the guide surfaces of the guide members 26 are retarded inwardly in comparison with the roller surface at the engagement positions 10*a,* 10*b,* 10*c* of the pinch roller 11, auxiliary roller 16 and needle roller 12 so that the pinch roller 11, auxiliary roller 16 and needle roller 12 are directly urged against the convey roller 10.

Further, in FIG. 6, the guide members 26 are disposed in the grooves 101, 102 so that contact areas between the convey roller 10 and the recording medium are substantially uniformly distributed in the main scan direction transverse to the sheet conveying direction. By arranging the guide members 26 in this way, it is possible to prevent of reduction of the conveying forces at the sheet supply portion and the sheet reverse rotation portion where the positive conveying forces are required in the U-turn path.

FIG. 5B shows the condition that the continuous sheet is conveyed. In this condition, the pinch roller 11 and the auxiliary roller 16 are completely spaced apart from the convey roller 10, and the urging force of the needle roller 12 against the convey roller is weakened. The continuous sheet is conveyed on protruded portions 26*a,* 26*b* of the guide members 26 protruded outwardly from the roller surface. As mentioned above, since the guide members 26 are disposed at substantially the same intervals in the main scan direction transverse to the sheet conveying direction, the continuous sheet is not contacted with the convey roller 10 except for the nip between the needle roller 12 and the convey roller 10, with the result that the conveying force of the convey roller is almost not transmitted to the continuous sheet. At the same time, since the guide members 26 are disposed in coaxial with the convey roller 10, protruded amounts of the protruded portions 26*a,* 26*b* of the guide members 26 can be controlled accurately.

In this way, by changing the contact area between the convey roller and the recording medium in dependence upon the cut sheet and the continuous sheet, when the cut sheet is used, the conveying force of the convey roller 10 is adequately transmitted to the cut sheet. And, when the continuous sheet is used, since the conveying force of the convey roller is almost not transmitted to the continuous sheet, the continuous sheet is conveyed only by the driving force of the pin feed tractor 3. Thus, both the cut sheet and the continuous sheet can be conveyed properly without arising inconvenience due to the difference in convey amount between the convey roller 10 and the pin feed tractor 3.

Incidentally, in the illustrated embodiment, a diameter of the convey roller 10 is selected to 38.808 mm and radius of each guide member at the engagement positions of the rollers 11, 16, 12 is selected to 18.9 mm. Thus, at the engagement positions 10*a,* 10*b* and 10*c* of the pinch roller 11, auxiliary roller 16 and needle roller 12, each guide member 26 is retarded inwardly from the surface of the convey roller 10 by about 0.5 mm. Further, the protruded portions 26*a,* 26*b* of the guide members 26 are protruded from the roller surface by about 0.5 mm.

Second Embodiment

In the above-mentioned first embodiment, while an example that the guide members are disposed in coaxial with the convey roller and the conveying force of the convey roller for conveying the continuous sheet is decreased by controlling the protruded amount of the each guide member was explained, in a second embodiment of the present invention, the conveying force of the convey roller for conveying the continuous sheet is decreased by changing positions of the guide members. Since the other construction and function of the second embodiment are the same as those of the first embodiment, the same elements are designated by the same reference numerals and explanation thereof will be omitted.

Figure 7B:
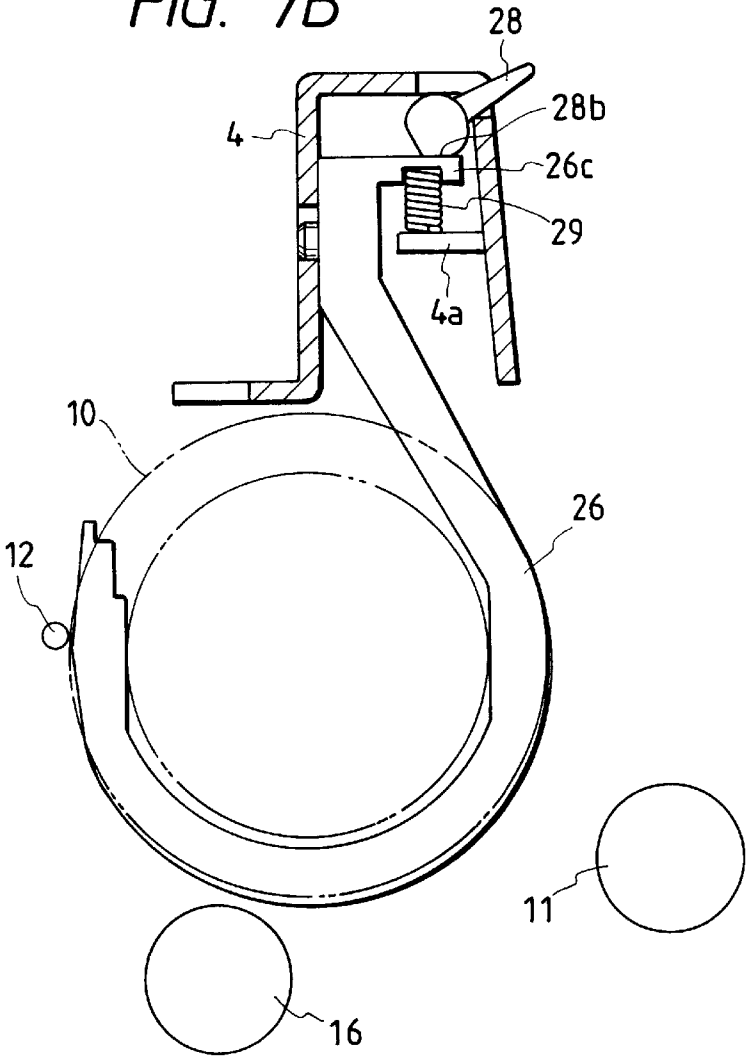
FIGS. 7A and 7B are schematic sectional views of a first convey means of an image recording apparatus according to a second embodiment of the present invention, where
Figure 7A:
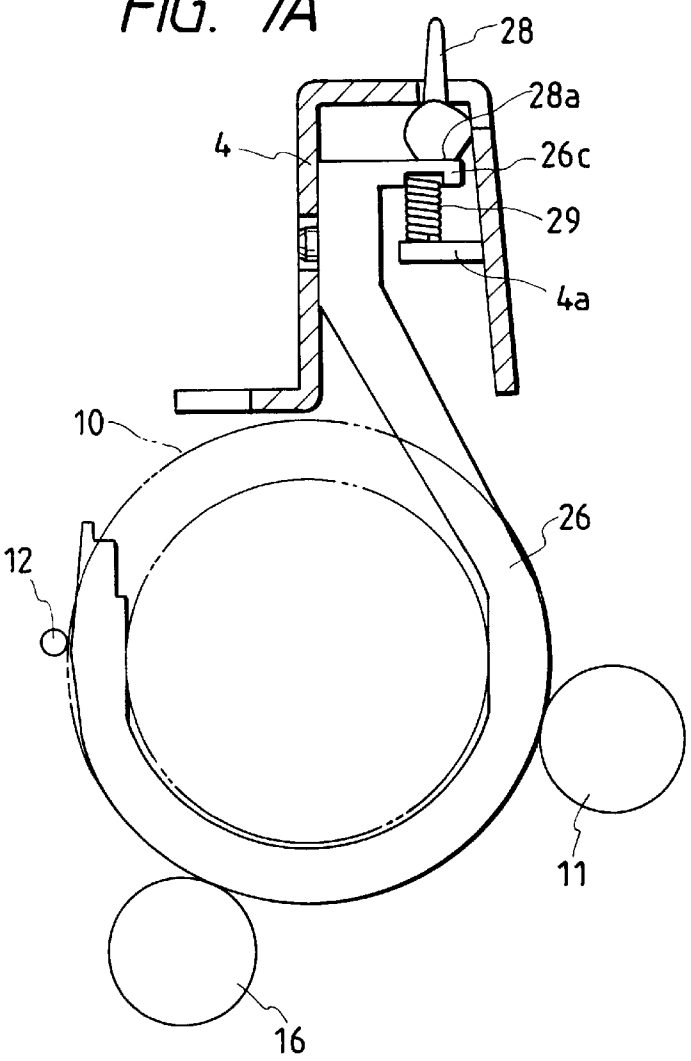

FIGS. 7A and 7B are sectional views showing a convey portion of a sheet convey system according to the second embodiment, where FIG. 7A shows a condition that a cut sheet is conveyed, and FIG. 7B shows a condition that a continuous sheet is conveyed.

In FIG. 7A, the pinch roller 11, auxiliary roller 16 and needle roller 12 are urged against the convey roller 10. An urging spring 29 is disposed between a bent portion 4*a* of a frame 4 and a tongue 26*c* of the guide member 26 to provide a biasing force. With this arrangement, by switching a switching lever 28, the position of the guide member 26 can be changed. That is to say, when a cam surface 28*a* of the lever 28 is selected, by the biasing force of the urging spring 29, the guide member 26 is lifted to a second position (retracted position) where the guide surface (outer contour) of the guide member 26 becomes flush with the roller surface of the convey roller or is retracted inwardly from the roller surface. Thus, the result that the pinch roller 11, auxiliary roller 16 and needle roller 12 are directly urged against the convey roller 10.

On the other hand, as shown in FIG. 7B, when a cam surface 28*b* of the lever is selected, the guide member 26 is lowered, in opposition to the biasing force of the urging spring 29, to a first position where the guide surface of the guide member 26 is protruded outwardly from the roller surface of the convey roller 10. As a result, the continuous sheet does not contact with the roller surface except for the nip between the needle roller 12 and the convey roller, thereby preventing the sheet jam.

Third Embodiment

Figure 8:
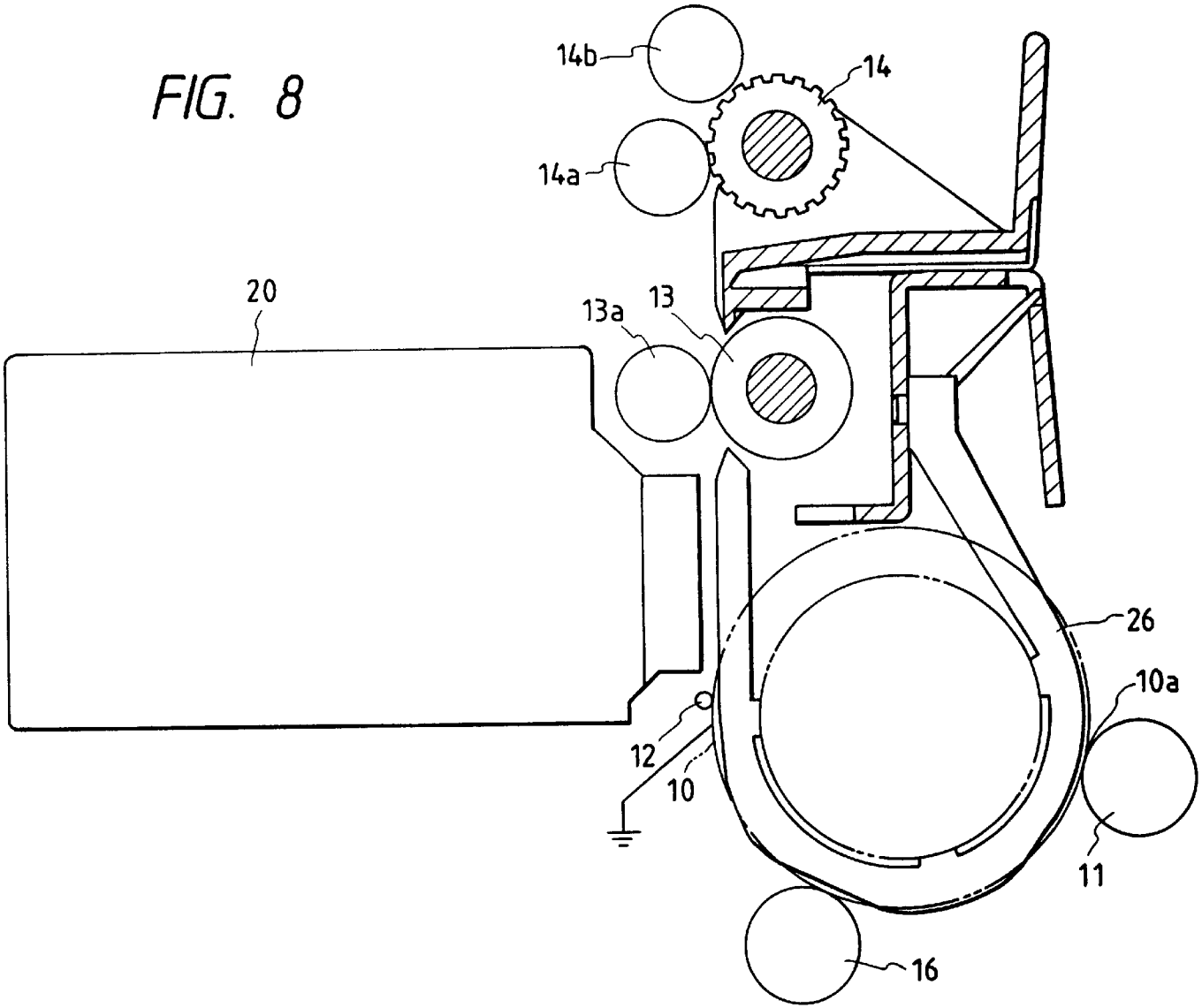
FIG. 8 is a schematic sectional view of a first convey means of an image recording apparatus according to a third embodiment of the present invention.
Figure 9:
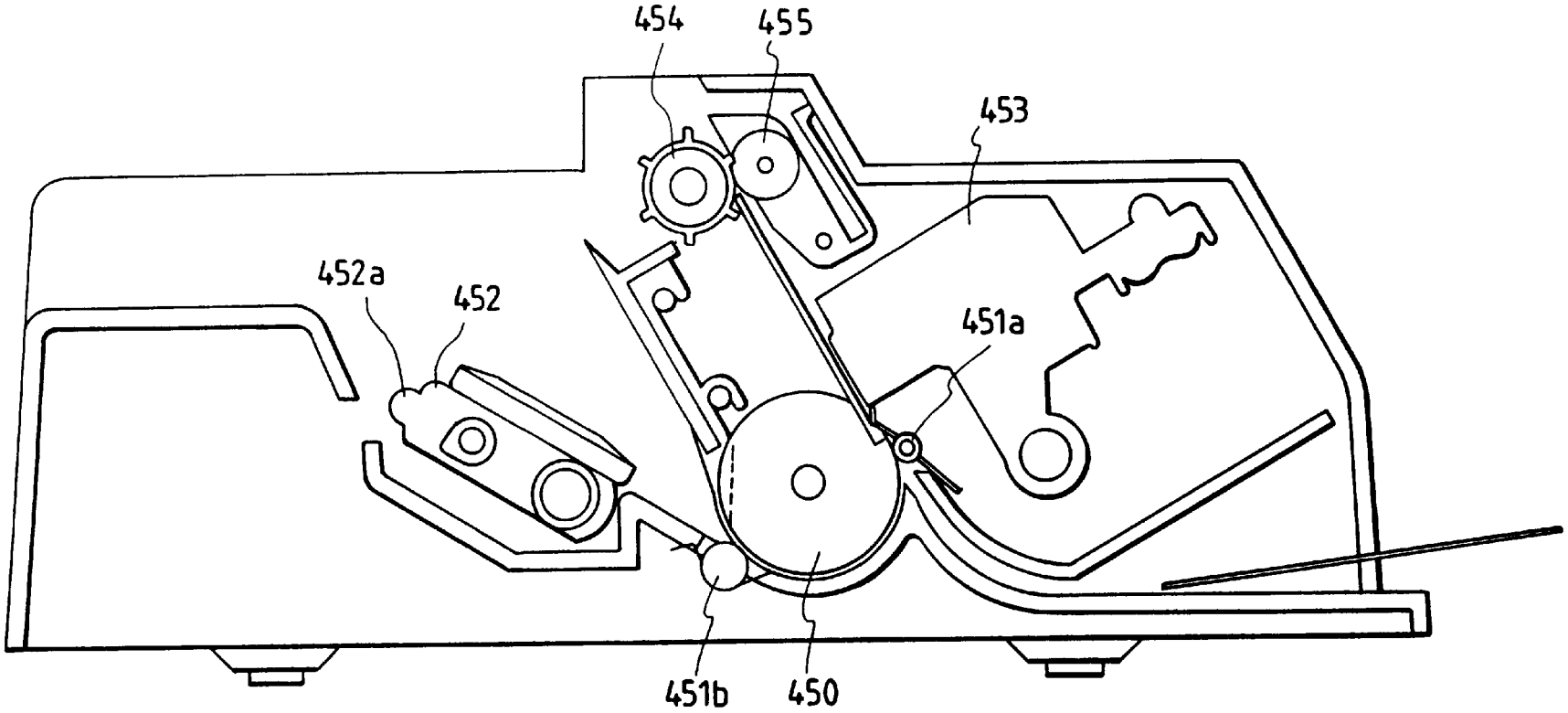
FIG. 9 PRIOR ART
FIG. 9 is a sectional view showing a main portion of a conventional image recording apparatus.

FIG. 8 shows a third embodiment of the present invention in which a guide member also acts as a guide for directing the recording medium to a correct position of the image recording portion. Since the other construction and function are the same as those of the first embodiment, the same elements are designated by the same reference numerals and explanation thereof will be omitted.

In the above-mentioned embodiment, while an example that the guide members are formed independently from the platen was explained, as shown in FIG. 8, in the third embodiment, the guide members also act as a platen. With this arrangement, the number of parts can be reduced, thereby making the apparatus cheaper.

Other Embodiments

A projection may be provided on the guide member at an upstream side of the engagement position 10*a* between the convey roller 10 and the pinch roller 11 in the recording medium conveying direction, which projection acts as a guide for effecting registration of the recording medium. With this arrangement, the recording medium can properly be directed from the second convey means to the first convey means, so that the recording medium can surely abut against the nip between the convey roller and the pinch roller, thereby improving the conveying ability for the recording medium.

Further, when the continuous sheet is conveyed on the protruded portions 26*a,* 26*b* of the guide members 26, since poor conveyance may occur due to generation of static electricity, the guide members may be formed from conductive material and the convey roller 10 or the holder 4 may be earthed, thereby eliminating the static electricity.

According to the present invention, by providing the guide means capable of changing the contact area between the recording medium and the drive convey roller at the curvature of the recording medium, the conveying force transmitted from the drive convey roller to the recording medium can be changed by changing the contact area between the drive convey roller and the recording medium in accordance with the kind of the recording medium, thereby conveying the recording medium properly. That is to say, when the single sheet (cut sheet) is used, the adequate conveying force is transmitted from the drive convey roller to the cut sheet so that the sheet can be conveyed only by the first convey means. On the other hand, when the elongated recording medium (fan-fold sheet) is used, the conveying force of the drive convey roller is not transmitted to the fan-fold sheet, with the result that the sheet can be conveyed by the second convey means. In any case, the recording medium can be conveyed properly without occurrence of inconvenience due to the difference in convey amount between the first and second convey means.

By switching the engagement and disengagement of the driven roller with respect to the drive convey roller, the conveying force transmitted from the drive convey roller to the recording medium can be changed.

When the guide means includes the guide member having the protruded portion protruded from the surface of the drive convey roller toward the recording medium in the condition that the driven roller is spaced apart from the drive convey roller, the recording medium does not contact with the drive convey roller, with the result that the conveying force is not transmitted from the drive convey roller to the recording medium. Further, by arranging the guide member in coaxial with the drive convey roller, the position of the guide member can be determined with respect to the roller surface of the drive convey roller with high accuracy.

When the guide means includes a guide member shiftable between a first position where it is protruded from the roller surface of the drive convey roller toward the recording medium and a second position where it is retracted from the roller surface, and a shift means for shifting the guide member, in the first position of the guide member, the recording medium does not contact with the drive convey roller, with the result that the conveying force is not transmitted from the drive convey roller to the recording medium.

By providing the guide members intermittently in a direction transverse to the recording medium conveying direction, when the single recording medium is conveyed, the recording medium can be conveyed only by the conveying force of the drive convey roller. When the guide member includes a guide for directing the recording medium (conveyed by the second convey means) to the correct position of the first convey means, more proper conveyance can be expected.

The guide member may include a guide for directing the recording medium from the first convey means to the correct position of the image recording portion. When the guide member is formed from the conductive material and is earthed, a bad influence due to static electricity generated by friction between the recording medium and the guide member can be eliminated.

By providing the guide member having a protruded portion for conveying the recording medium while separating it from the drive convey roller at non-engagement positions between the drive convey roller and the recording medium, the recording medium can properly be conveyed in accordance with the kind of the recording medium.

The ink jet head used in the above-mentioned embodiments has heat generating elements disposed in nozzles for discharging ink, so that ink droplets are discharged from the nozzles by growth of bubbles generated in the ink by thermal energy of the heat generating element.

What is claimed is:

1. An image recording apparatus comprising:

image recording means for recording an image on a recording medium;

first convey means for conveying the recording medium to an image recording portion of said image recording means while bending the recording medium along a drive convey roller by means of said drive convey roller;

second convey means for conveying an elongated recording medium having a plurality of pin holes to said first convey means;

characterized by a guide means capable of changing a contact area between the recording medium and said drive convey roller at a curved portion of the recording medium along said drive convey roller; and a driven roller supported for movement to be engaged by or disengaged from said drive convey roller and having a switching means for selecting such engagement or disengagement, when a single recording medium is conveyed, the single recording medium is conveyed while being pinched between said drive convey roller and said driven roller, and, when the elongated recording medium is conveyed, the elongated recording medium is conveyed in a condition that said driven roller is disengaged from said convey roller, wherein said guide means is fixedly supported independently from said drive convey roller and has a guide member having a projection protruding from a roller surface of said drive convey roller toward the recording medium and disposed at a non-contact position between said driven roller and said drive convey roller.

2. An image recording apparatus according to claim 1, wherein, when the elongated recording medium is conveyed, the contact area is decreased by said guide means.

3. An image recording apparatus according to claim 1, wherein said guide member is disposed in coaxial with said drive convey roller.

4. An image recording apparatus according to claim 1, wherein said guide means includes the guide member shiftable, independently from said drive convey roller, between a first position to be protruded from a surface of said drive convey roller toward the recording medium, and a second position not to be protruded toward the recording medium with respect to said drive convey roller, and a means for shifting said guide member.

5. An image recording apparatus according to claim 4, wherein when the single recording medium is conveyed said guide member is shifted to said second position, and when the elongated recording medium is conveyed said guide member is shifted to said first position.

6. An image recording apparatus according to claim 5, wherein said guide member is disposed partially in a direction transverse to the recording medium conveying direction.

7. An image recording apparatus according to claim 6, wherein said guide member includes a guide for directing the recording medium conveyed by said second convey means to a correct position of said first convey means.

8. An image recording apparatus according to claim 7, wherein said guide member includes a guide for directing the recording medium from said first convey means to a correct position of said image recording portion.

9. An image recording apparatus according to claim 8, wherein said guide member is formed from conductive material and is earthed.

10. An image recording apparatus according to claim 1, wherein said second convey means includes a pin feed tractor, and when the elongated recording medium is conveyed, the elongated recording medium is conveyed while engaging pin holes of the recording medium by pins of said pin feed tractor.

11. An image recording apparatus according to claim 10, wherein said image recording means includes an ink jet head for forming the image on the recording medium by discharge ink.

12. An image recording apparatus according to claim 1, wherein said image recording means includes an ink jet head for forming the image on the recording medium by discharge ink.

13. An image recording apparatus according to claim 12 or 11, wherein said image recording means forms the image by ink droplet discharged by thermal energy.

14. An image recording apparatus comprising:

an image recording means for recording an image on a recording medium;

a drive convey roller for conveying the recording medium to an image recording portion of said image recording means while bending the recording medium along said drive convey roller;

a driven roller capable of being engaged by and disengaged from said drive convey roller and capable of conveying the recording medium while pinching the recording medium between said drive convey roller and said driven roller; and a convey means for conveying a recording medium having a plurality of pin holes to a nip between said drive convey roller and said driven roller;

characterized by a guide member having a protruded portion for conveying the recording medium while spacing the recording medium apart from said drive convey roller, said protruded portion being disposed at a position other than the nip between said drive convey roller and said driven roller.

* * * * *